United States Patent [19]

Brumit et al.

[11] Patent Number: 4,582,967

[45] Date of Patent: Apr. 15, 1986

[54] KEY SWITCH ASSEMBLY

[75] Inventors: Dale E. Brumit; Richard R. Watkins; Hans W. Daniel, all of Tucson, Ariz.

[73] Assignee: TEC, Inc., Tucson, Ariz.

[21] Appl. No.: 663,488

[22] Filed: Oct. 22, 1984

[51] Int. Cl.[4] ..... H01H 13/14

[52] U.S. Cl. ..... 200/5 A; 200/340; 400/472; 400/479

[58] Field of Search ..... 200/5 A, 159 B, 340, 200/329; 400/472, 477, 478, 479, 479.1, 479.2

[56] References Cited

U.S. PATENT DOCUMENTS 4,315,114 2/1982 Monti, Jr. ..... 200/159 B X
4,467,150 8/1984 Leitermann et al. ..... 400/479 X
4,486,637 12/1984 Chu ..... 200/5 A X

*Primary Examiner*—G. P. Tolin

*Assistant Examiner*—Morris Ginsburg

*Attorney, Agent, or Firm*—Gregory J. Nelson

[57] ABSTRACT

A key switch assembly for interposition between a PCB and a cover plate for actuating a contact element such as a snap dome. The key switch includes a body having a cantilever actuator arm hingedly secured to the body. The body is located with respect to the cover plate by means of an upwardly extending dowel pin. The underside of the actuator arm carries a generally cylindrical striker element which when the arm is depressed engages the snap dome in line contact. The upper surface of the actuator arm has a mounting projection which projects through an aperture in the cover plate and is adapted to receive a key cap. Manual pressure applied to the key cap will cause the actuator arm to pivot about hinge section bringing the striker element into contact with the snap dome.

8 Claims, 10 Drawing Figures

KEY SWITCH ASSEMBLY

The present invention relates to switches and more particularly to a keyboard switch assembly with tactile feedback for use in keyboards for electronic devices.

The construction of electronic calculators, keyboards and other electronic apparatus for digital control and data entry utilize snap action resilient contact elements in conjunction with conductive substrates such as printed circuit boards (PCB's). The substrate carries a plurality of conductive circuit paths which are selectively bridged upon depression or actuation of the conductive resilient contact element. The contact elements may be in different configurations but are generally dome shaped disposed adjacent the substrate with a portion of the dome being in electrical and in physical contact with a portion of one of the conductive paths. The central region of the resilient dome is in registry over selected portions of the conductive path or a terminal so as to enable electrical connection between the paths when the dome is actuated by application of manual pressure. The dome shape is preferred because it exhibits a tactile snap action although various other contact elements and other geometric shapes such as polygonal, triangular or the use of relatively thin, flexible spring members has also been suggested in the prior art. In some applications the contact elements may be directly actuated by the user in which case the user simply applies force with the finger to the contact causing it to actuate. However, in the construction of many components such as keyboards, the use of a key switch to actuate the contact element is preferred. In addition to providing the tactile snap action and positive switching, the ideal key switch should be compact, simple, reliable and free from interference. A further requirement of such key switches is that they be easy to maintain.

In recent years there has been considerable development in the area of keyboard devices of the type using key switches. Products such as computer data terminals and telephones utilize keyboard switch assemblies in which the snap action contact member is actuated by separate key switch. Generally these assemblies are constructed with a keyboard overlying the conductive substrate. The key switches are integrally formed in the keyboard at predetermined locations and are hingedly secured so that they may be bendable or depressible to operate and engage the subjacent contact members. Typical U.S. patents in the prior art showing switches of this type are Nos. 4,355,483; 4,323,740; 4,032,729; 4,128,744; 4,190,748; and 4,360,722.

While assemblies as represented by the aforementioned patents are adequate for the intended purpose, certain deficiencies and limitations are inherent in such devices. Problems arise in maintaining alignment of the key switch and the center actuating point of the metal dome or contact member. Also, difficulties arise in accurately maintaining the spacing between the conductive substrate and the cover plate. Key switch assemblies as described above in which the keys are integrally formed in the cover plate also do not provide great design flexibility and further pose increased maintenance problems as a deficiency or problem with one key requires that the entire top plate in which the array of switches are formed be replaced.

Therefore, it becomes an object of the present invention to provide an improved key switch assembly which is versatile, simple and easy to maintain and provides the keyboard designer great flexibility in designing custom boards.

The above objects of the present invention, are accomplished by a key switch formed in a one-piece cantilever assembly with an actuator arm connected by a living hinge to the body member. The key switch is insertable between the top cover plate and the substrate with the body member maintaining the spacing between the substrate and the cover plate. A locator pin establishes the relative position of the key switch to the contact member. The underside of the key switch carries a barrel-shaped actuator bar which contacts the subjacent contact element or dome. A projection on the upper surface of the actuator arm extends through an aligned aperture in the top cover plate to receive appropriate key cap.

Accordingly, an important object of the present invention is to provide a novel or improved key switch assembly providing snap action with tactile feedback.

A further object of the present invention is to provide an improved keyboard assembly and key switch mechanism which is economical to produce and is reliable in operation.

Still another object of the present invention is to provide a novel, improved keyboard assembly which provides positive alignment with respect to the top panel and to the contact element.

Still another object of the present invention is to provide a key switch assembly which provides positive actuation of the conductive element or dome.

Still another object of the present invention is to provide a keyboard assembly and a keyboard switch mechanism which is easily serviceable and provides substantial flexibility of design.

Other objects and advantages of the present invention will be apparent to and understood by those skilled in the art in the following detailed description and drawings in which.

Figure 1:
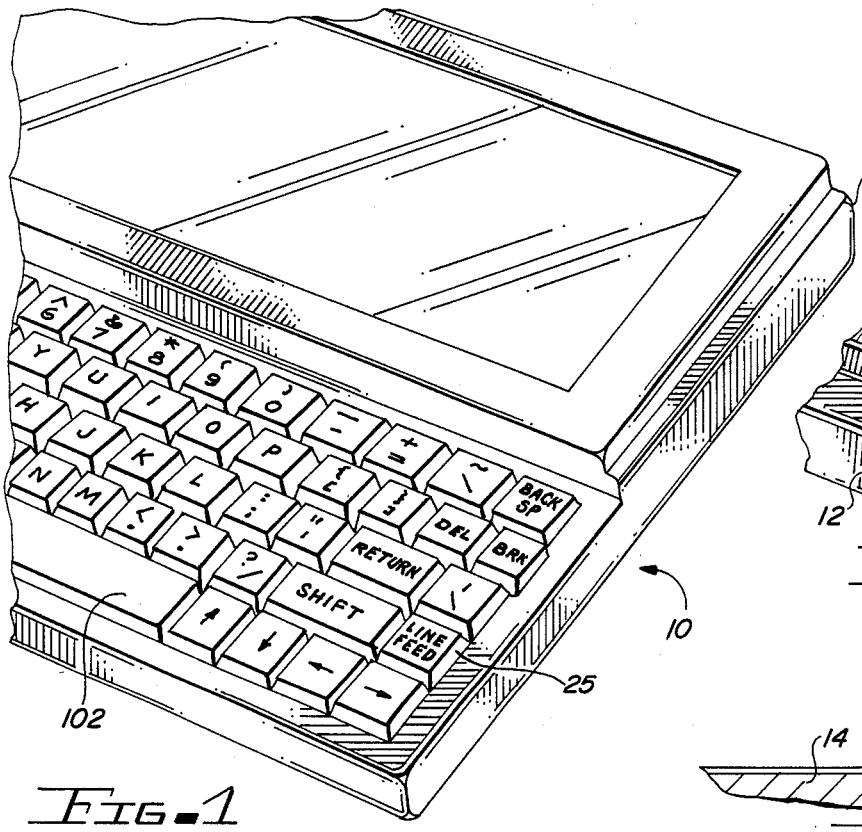
FIG. 1 is a perspective view of a portion of a keyboard assembly incorporating the key switch actuator of the present invention.
Figure 2:
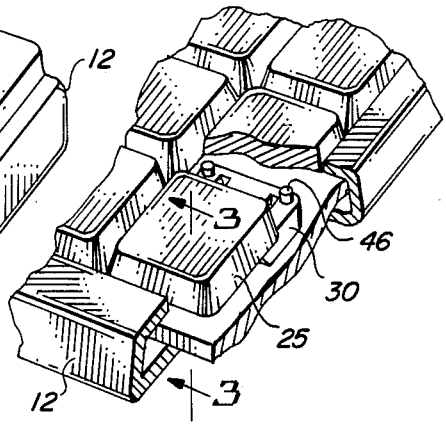
FIG. 2 is a detail perspective view showing the key switch.

Turning now to the drawings, particularly FIGS. 1 through 6 which show a keyboard generally designated by the numeral 10 of the type commonly utilized in connection with computer terminals and other similar electronic equipment. The keyboard 10 consists of a housing 12 within which is a substrate 14 such as a PCB containing appropriate conductive pathways. A plurality of contact elements shown as dome switches 16 which are selectively placed with respect to the substrate 14. The contact elements 16 are generally positioned having a peripheral section in contact with a selected portion of the conductive path in the substrate 14 and upon depression of the center portion an electrical pathway is established. The contact element may be contoured and formed of metal or other conductive material. As pointed out above, the precise configuration of the element 16 may vary. For a more detailed description of the type of element described, reference is made to U.S. Pat. No. 3,967,084.

A generally planar cover plate 18 extends in parallel spaced-apart arrangement above the substrate 14 defining a pre-established spacing 20 therebetween. The cover plate is preferably formed of suitable plastic material as is known in the art. A plurality of windows or apertures 22 are defined in the cover plate 18 at spaced-apart locations associated with each of the switches 16. The apertures 22 will accomodate a key cap 25 as will be more fully explained hereafter.

The key switch 30 for actuation of the contact element 16 is an integral or one-piece assembly preferably molded from a suitable nonconductive plastic material such as polypropylene by injection molding techniques. The key switch 30 has a generally U-shaped body member 32 including two forwardly extending leg members 34. Bight section 35 extends transversely between the leg members. The height of the body 32 corresponds to the pre-determined spacing 20 between the upper surface of the PCB and the lower surface of the cover plate. Therefore the body serves to establish and maintain this spacing.

Forwardly extending from the upper portion of body section 35 intermediate legs 34 is cantilever actuator arm 36. Arm 36 is hingedly secured to the body 32 at a hinge section 38 of reduced material thickness. Hinge section 38 is a "living hinge" forming a pivot point for the arm. Typically, the nominal thickness of the material in the actuator arm would be in the order of 0.05" with the thickness of the reduced hinge area being typically 0.01". Switch closure is accomplished by exerting a manual force downward on the key cap 25 which causes the arm 36 to deflect downwardly. The key cap is mounted on the upper surface of the arm at projection 40 which is generally rectilinear and frictionally engages a cooperating recess in the key cap 25. The key cap at least partially extends through the aperture 22 in the cover. The particular shape of the key switch again varies but preferably the key cap extends at least to the terminus of the actuator arm 36 so that the manual pressure applied to the key cap is applied near the end of the arm for maximum leverage and tactile feel.

Figure 4:
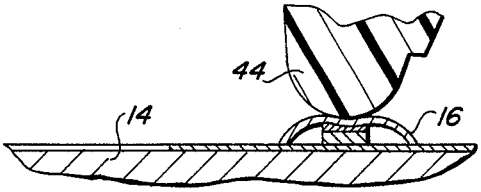
FIG. 4 is a detail view as indicated in FIG. 3.
Figure 3:
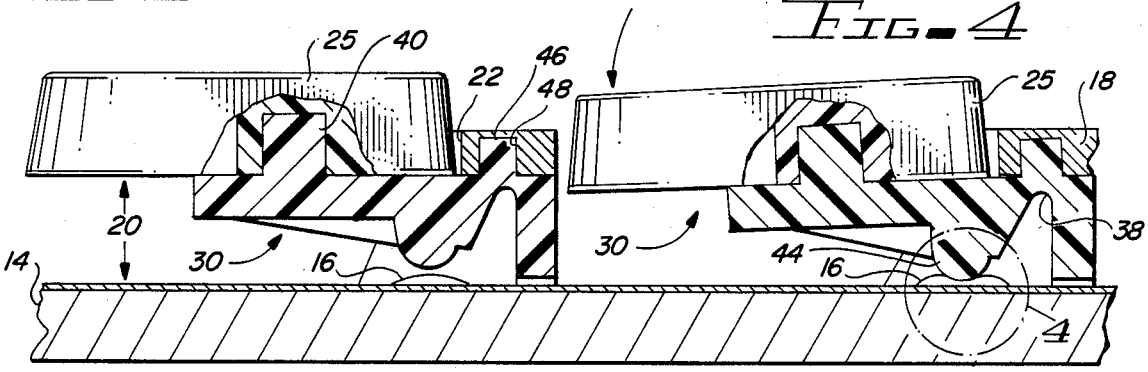
FIG. 3 is a sectional view of a portion of a keyboard taken along lines 3—3 of FIG. 2 showing an actuator switch in both a non-actuated and in an actuated position.
Figure 5:
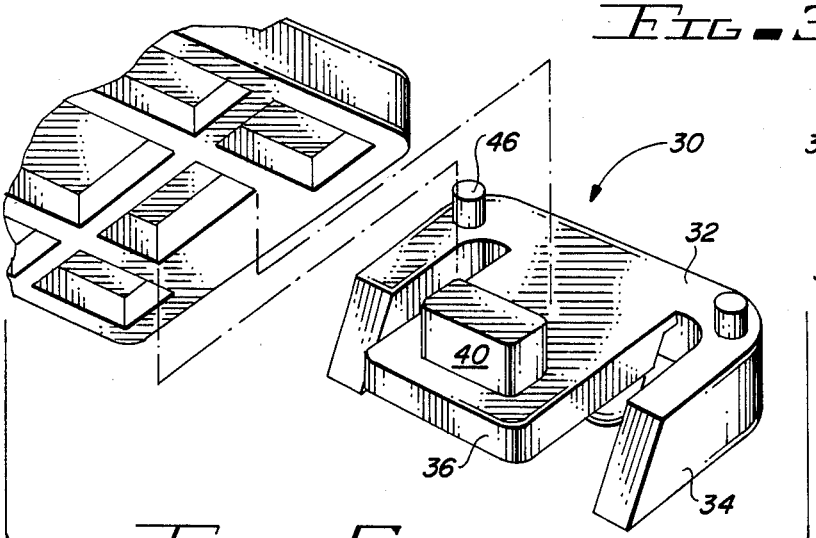
FIG. 5 is an exploded view of a key switch assembly.
Figure 6:
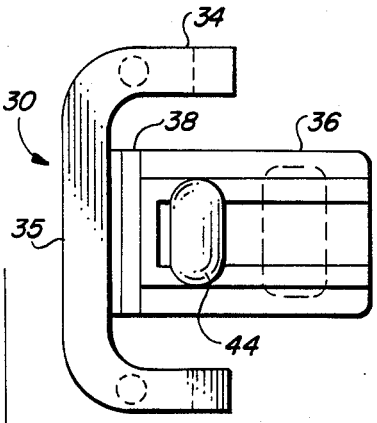
FIG. 6 is a top view of a key switch.

In the depressed position as shown in FIG. 3, the striker bar 44 on the underside of the actuator arm 36 engages the contact element 16. The striker bar, as best seen in FIG. 4, is generally cylindrical in configuration. This is in contrast to most conventional striker elements which are generally hemispherical. The cylindrical, elongate striker bar 44 provides positive alignment of the actuator striker to the center of the metal dome to insure that upon depression the striker provides line contact to actuate the contact 16.

Actuator arm 36 is positioned and held in place by one or more locating pins 46 which project upwardly from the body 32. Appropriate apertures 48 are provided in predetermined locations in the underside of the cover plate 18 to receive the locating pins. As mentioned above, the vertical height of the body section 32 establishes and maintains the spacing between the substrate 14 and the cover plate 18. In addition, the actuator body is positioned to provide positive alignment of the key cap to the cover plate and insures accurate spacing between the PCB and the cover plate. The construction is simple and minimizes the parts required for assembly.

In use, the user simply applies manual force to the actuator arm by means of downward pressure with a finger on the key cap 25. The use of a cantilever actuator in this manner provides good tactile feedback to the operator. When pressure is applied to the actuator arm, the arm pivots downward about the hinge point 38 applying force to the contact element 16 resulting in switch closure. Since the actuator arm assembly is precisely positioned by means of the dowel pin locator, the enlarged cylindrically designed striker precisely engages the center of the dome in line contact. The use of the living hinge results in a stable pivot point for the switch assembly. This permits ease of operator actuation of the switch while eliminating movement of the actuating arm that causes loss of registration with the centerpoint of the dome.

The unitary assembly also reduces cost of manufacturing and increases reliability. Because each key switch assembly is independent, custom designs of keyboards is facilitated giving the electronics designer greater flexibility. Further, maintenance is easier in that if a problem exists with a single key switch, one only need replace that particular actuator. With the integral actuators as described above, the entire panel would be required to be replaced. Further, with the present invention, the key caps 25 are separate from the actuator arm. This allows the key caps to be individualized and identified by appropriate indicia or color and/or different shapes.

Figure 8:
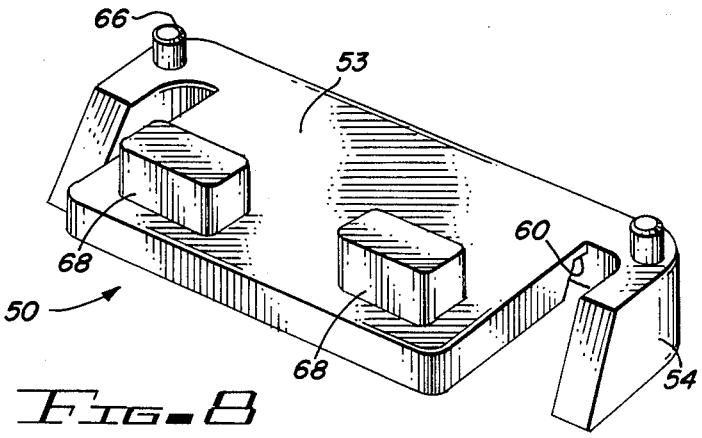
FIG. 8 is a perspective view of of still another embodiment of the key switch of the present invention.
Figure 9:
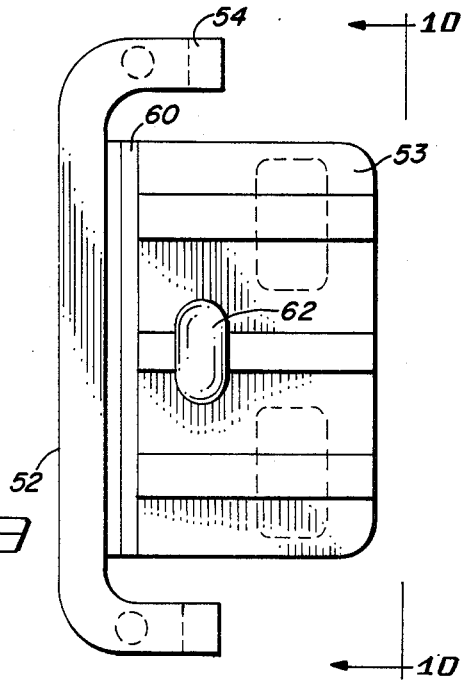
FIG. 9 is a bottom view.
Figure 10:
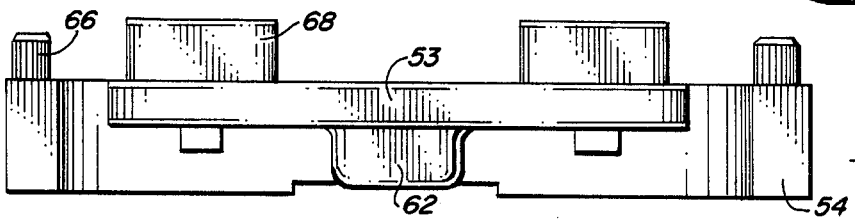
FIG. 10 is a sectional view taken along lines 10—10 of FIG. 9.

FIGS. 8 to 10 show an alternate embodiment of the present invention which is generally designated by the numeral 50. In this embodiment, the key switch is again of a unitary molded structure preferably of suitable non-conductive flexible material such as polypropylene. The key switch again includes a generally U-shaped body 52 having an intermediate arm 53 and forwardly extending arms 54. The actuator extends forwardly intermediate of the arms and is hingedly secured to the body at reduced thickness hinge section 60. Upwardly extending projections 66 on body 53 are provided as locating points for securement to the cover plate as described above. Appropriate generally cylindrical striker member 62 is provided on the underside of the actuator. In the embodiment of FIGS. 8 to 10, the actuator arm is dimensioned having a width somewhat greater than its length. Accordingly, a pair of upwardly extending projections 68 are provided on the upper surface of arm 53 for engagement with appropriate openings in the key cap, not shown. Key switch 50 is configured having a greater transverse dimension than the key cap 25 shown in FIGS. 1 to 6 and accomodates a larger key cap, not shown. For example, the key cap associated with the key switch in FIGS. 1 to 6 might be used for the individual alphanumeric keys of a conventional keyboard of a terminal or word processor. The key switch of FIGS. 8 to 10 typically would be used for mounting keys such as space and return keys which are generally of larger dimensions.

Figure 7:
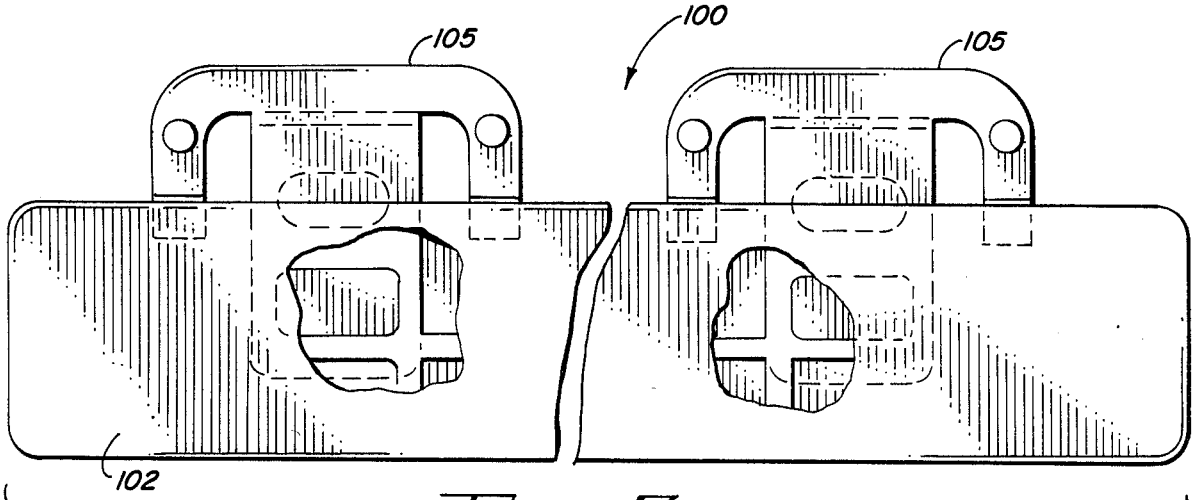
FIG. 7 is a top view of an alternate embodiment of the keyboard switch of the present invention.

FIG. 7 shows still another embodiment of the present invention generally designated by the numeral 100. In this embodiment, an elongate key 102 is supported by a pair of spaced-apart key switches 105. The key switches 105 are constructed generally as described with reference to FIGS. 1 to 6. However, because of the length of the key, the key switches 105 support the key at spaced-apart locations adjacent the ends of the key. In other respects, the actuator is as has been described above.

The present invention has been described with reference to several specific embodiments thereof for the purpose of illustrating the manner in which the invention may be used. It will be appreciated by those skilled in the art that the invention is not limited to the specific embodiments. Accordingly, any and all modifications, variations or equivalent arrangements which occur to those skilled in the art should be considered within the spirit and scope of the invention.

We claim:

1. A key switch actuator for use in a keyboard assembly including a substrate panel defining conductive paths and having deflectable contact means associated therewith and a cover panel spaced apart above said substrate panel defining aperture means therein, said key switch actuator comprising:

(a) a body having a predetermined height and adapted to be interposed between said cover panel and said conductive substrate panel to maintain the spacing therebetween;

(b) position location means associated with said body for engagement with one of said panels to position said key switch actuator relative thereto;

(c) cantilever actuator arm means having top and bottom surfaces, attachment means associated with said actuator arm means for attachment of a key cap having a transverse width, said actuator arm means having a distal end and being secured at a proximal end to said body at a hinge section integrally connecting said actuator arm means to said body immediately adjacent said body forming a single key switch actuator said actuator arm means adapted to pivot downward upon application of manual forces to said actuator arm means, said actuator arm means supporting the key cap substantially across its width to resist twisting upon manual depression of said actuator arm means through said key cap; and (d) striker means projecting from the bottom surface of said actuator arm means at a location between the hinge section and the location of said key cap attachment means and positioned to engage said contact means when said actuator arm means is actuated downwardly a predetermined distance to provide leveraged actuation and providing the user tactile feedback and for establishing a path of electrical conductivity across said contact means in an actuated position.

2. The key switch actuator of claim 1 wherein said top surface defines at least one mounting projection thereon and said key cap defines an aperture for frictionally engaging said mounting projection.

3. The key switch of actuator of claim 1 wherein said position location means comprises at least one projection extending upwardly from said body for engagement in cooperating aperture means defined in said cover panel.

4. The key switch actuator of claim 1 integrally formed by plastic molding techniques.

5. The key switch actuator of claim 1 further including arm means extending forwardly from said body adjacent said actuator arm means.

6. The key switch actuator of claim 1 wherein the top surface of said arm means carries multiple key cap mounting projections for detachable engagement of said key cap.

7. The key switch actuator of claim 1 wherein said striker means is generally elongate for providing line contact with said contact means.

8. The key switch actuator of claim 7 wherein said striker means is generally semi-cylindrical.

* * * * *